US006321955B1

(12) United States Patent
Ellzey et al.

(10) Patent No.: US 6,321,955 B1
(45) Date of Patent: Nov. 27, 2001

(54) STORAGE DEVICE FOR STORING SUSPENDERS

(76) Inventors: Gavin L. Ellzey, 5521 W. Wornall Rd., Kansas City, MO (US) 64111; Michael S. Bonnell, 5804 W. 155th St., Overland Park, KS (US) 66223

( * ) Notice: Subject to any disclaimer, the term of this patent is extended or adjusted under 35 U.S.C. 154(b) by 0 days.

(21) Appl. No.: 09/611,785

(22) Filed: Jul. 7, 2000

Related U.S. Application Data

(62) Division of application No. 09/131,479, filed on Aug. 10, 1998, now Pat. No. 6,089,423.

(51) Int. Cl.[7] ..... A47G 25/14
(52) U.S. Cl. ..... 223/85; 223/DIG. 1
(58) Field of Search ..... 223/85, DIG. 1, 223/DIG. 4; 211/113; D6/315, 317

(56) References Cited

U.S. PATENT DOCUMENTS

| | | |
|---|---|---|
| D. 157,273 | 2/1950 | Lormor . |
| D. 291,031 | 7/1987 | Luongo . |
| 2,543,234 | 2/1951 | Dramin . |
| 4,718,546 | 1/1988 | Kolton et al. . |
| 4,863,043 | 9/1989 | Bowen . |
| 5,209,382 | 5/1993 | Chang . |
| 5,642,841 | 7/1997 | Beaty . |
| 5,803,321 | 9/1998 | Willinger et al. . |
| 5,901,888 | 5/1999 | Schneider et al. . |

*Primary Examiner*—Bibhu Mohanty
(74) *Attorney, Agent, or Firm*—Husch & Eppenberger, LLC; Robert E. Muir; Kevin M. Kercher

(57) ABSTRACT

A storage device for storing suspenders has an upstanding, flat and substantially rigid base. At least one pair of elongate member cantilevers extend outwardly from and perpendicular to the surface of the base. The back suspender waistband button engaging stems are received by the elongate member cantilevers. One embodiment includes a hook portion mounted at the top of the base for hanging the storage device. Furthermore, the storage device may have an orifice in its base in the position directly below the hook portion for hanging a second storage device. Another embodiment may be mounted to a wall or a closet door.

3 Claims, 4 Drawing Sheets

1
2
3
4
5
6
7
8
8a
2S
2E
4S
4E
4B
10
11
12

STORAGE DEVICE FOR STORING SUSPENDERS

CROSS REFERENCE TO A RELATED APPLICATION

This application is a division of application Ser. No. 09/131,479, filed Aug. 10, 1998 now U.S. Pat. No. 6,089, 423.

BACKGROUND OF THE INVENTION

The present invention relates generally to storage devices and, more particularly, to a storage device for storing suspenders.

Braces are relatively expensive items of clothing that are typically stored in drawers or boxes. Storing suspenders in drawers or boxes often causes wrinkling and creasing and may otherwise adversely affect the appearance of the suspenders. Suspenders may also become wrinkled, creased, or otherwise damaged when packed for traveling in suitcases or other types of luggage.

Other similar devices in the art provide a means for storing a single pair of suspenders for display in stores. However, these devices cannot store more than one pair of suspenders at a time. Furthermore, such devices are constructed of a thin, flexible plastic which gives the devices a plain, inexpensive appearance. Such devices also are impractical for everyday storage because they have insufficient means for holding suspenders for storage and have small hook portions that are insufficient for hanging the device on a standard closet pole.

It would be advantageous to provide a device which overcomes the problems described above.

SUMMARY OF THE INVENTION

An objective of the present invention is to provide a device for storing suspenders that prevents wrinkling, creasing, or other damage to the suspenders that is often caused by storing the suspenders in drawers, boxes or other storage means. Another objective of this invention is to provide a device for storing a plurality of pairs of suspenders. Still another object is to provide a device which is useful for storing suspenders while traveling.

In accordance with the present invention there is provided a storage device for storing a pair of suspenders comprising an upstanding, flat and substantially rigid base having at least one pair of elongate member cantilevers extending outwardly and perpendicular to the surface of the base and a hook portion mounted at the top of the base for hanging the storage device.

BRIEF DESCRIPTION OF THE DRAWINGS

Reference is now made to the drawings which illustrate the best known mode of carrying out the invention and wherein the same reference numerals indicate the same or similar parts throughout the several views.

DETAILED DESCRIPTION

Figures 1, 2, 3:
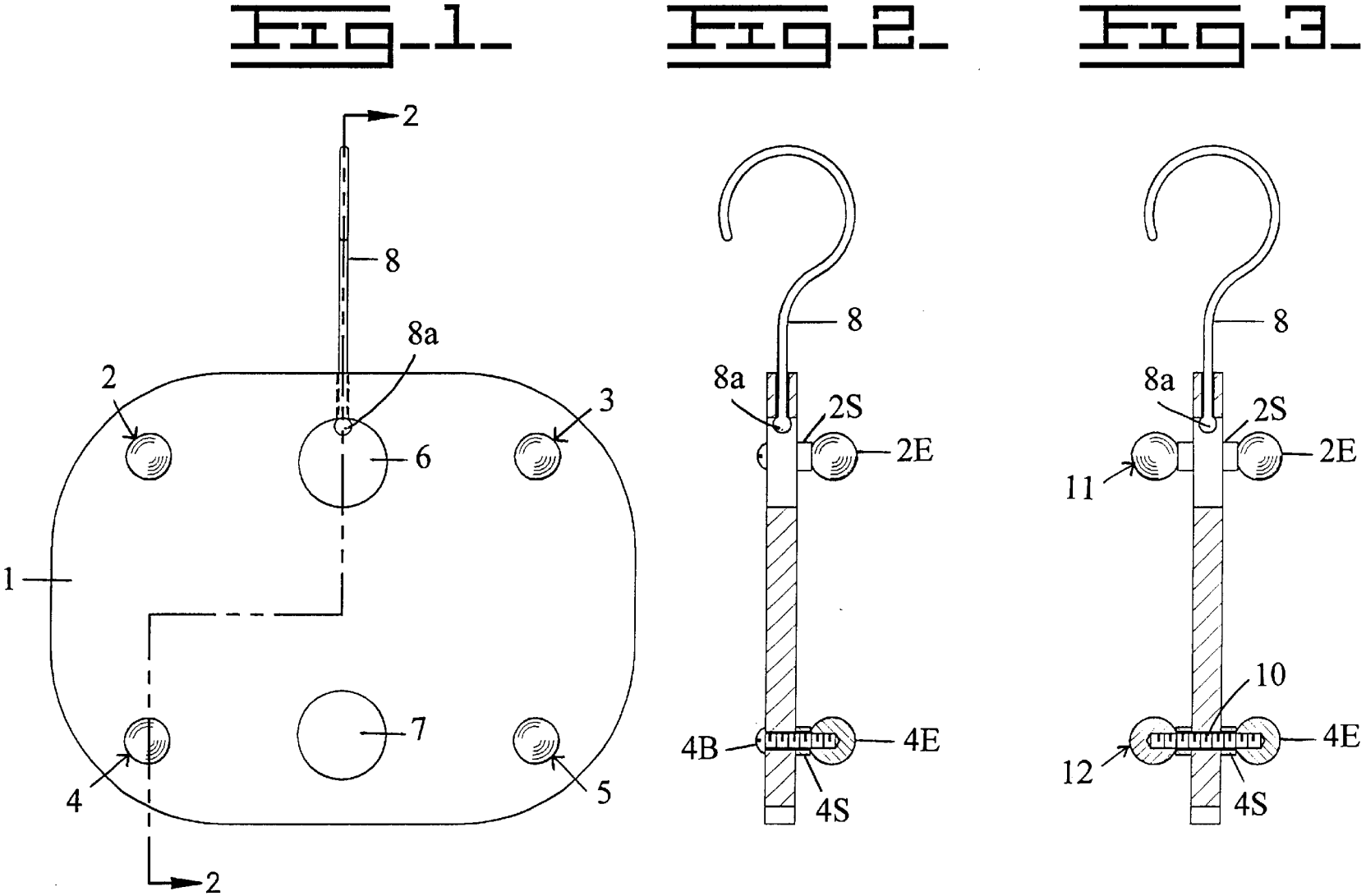
FIG. 1 is a front elevational view of one embodiment of a storage device in accordance with the present invention.
FIG. 2 is a cross-sectional view taken generally along line 2—2 of FIG. 1.
FIG. 3 is a cross-sectional view similar to FIG. 2, but showing another embodiment of the present invention which has means for storing a pair of suspenders on either face of the storage device base.

FIGS. 1–3 show a storage device for storing a plurality of pairs of suspenders having an upstanding, flat and substantially rigid base 1. The base 1 can be constructed of wood, thick, rigid plastic, or any other material that sufficiently resists bending under the weight of a plurality of pairs of suspenders. A hook portion 8 for hanging the device is mounted at the top of the base 1 of the storage device. The hook portion is advantageously designed such that the storage device can be hung on a standard closet pole or on a means for supporting clothes hangers in a suit bag. The hook portion 8 may be constructed of wire, wood, or any other material which is strong enough to support the weight of the storage device base 1 and at least two pairs of suspenders.

Mounted to the face of the base 1 of the storage device shown in FIG. 1 are four elongate member cantilevers 2, 3, 4 and 5 extending outwardly from and perpendicular to the surface of the base 1. These elongate member cantilevers 2, 3, 4 and 5 have a shank denoted by the suffix "S" and having a length sufficient for residence in the waistband button engaging stems of a pair of suspenders, by which the suspenders are secured to the storage device. It is advantageous for the elongate member cantilevers 2, 3, 4 and 5 to have attached bulbous ends denoted by the suffix "E" for better retention of the waistband button engaging stems of a pair of suspenders. Taking cantilever 4 as an example, the shank 4S may be a washer over a threaded bolt 4B and the bulbous end 4E may be internally threaded to retain the assemblage. It is further advantageous for the elongate member cantilevers to be spaced apart approximately the width of the spacing between suspender buttons on trousers, preventing the disfigurement or misshaping of the waistband button engaging stems of the suspenders.

FIG. 3 shows another embodiment of the present invention where identical parts shown in FIGS. 1 and 2 are indicated by the same numerals. Two pairs of elongate member cantilevers 11 and 12 are mounted on the opposite face of the flat and substantially rigid base 1. The elongate member cantilevers 11 and 12 also advantageously have bulbous ends for better retention of the waistband button engaging stems of the suspenders. The storage device, as shown in FIG. 3, can store four pairs of suspenders at one time. In this embodiment a threaded member 10 replaces bolt 4B and threadedly connects, for example, both cantilevers 4 and 12.

Two orifices 6 and 7 in the base 1 of the storage device are conveniently disposed directly below the hook portion 8. The lowermost orifice 7 is large enough to receive the hook portion of a second storage device, thereby allowing that second storage device to be connected to and supported by the first storage device. In addition, the lowermost orifice 7 is small enough to have sufficient retention capability, preventing the second storage device from accidentally becoming disengaged from the first storage device. The uppermost orifice 6 is conveniently the same size as the lowermost orifice 7 for aesthetic purposes but large enough for assemblage of the hook portion 8. The depending end 8*a* of the hook portion may be upset during assembly for retention or may be enlarged as shown.

The embodiments of the present invention shown in FIGS. 1–3 may also be useful for storing suspenders during travel. For example, the storage device may be hooked into a suit-bag, much like a hanger for a jacket or suit is hung in a suit-bag. This would solve the problem or wrinkling or creasing of the suspenders often caused when the suspenders are packed in a suitcase.

Figure 4:
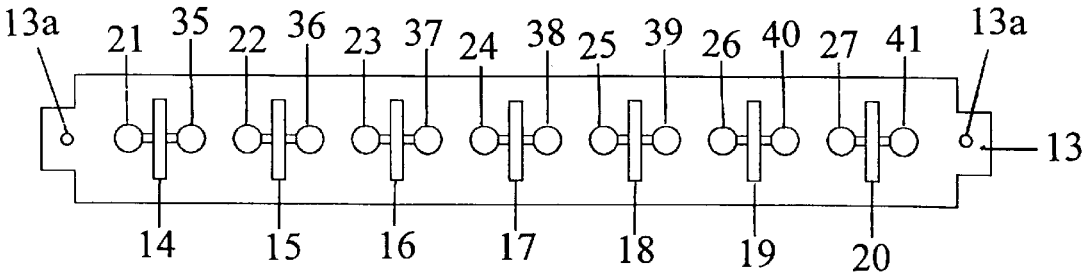
FIG. 4 is a front elevational view of a third embodiment of a storage device for storing a plurality of suspenders and having a plurality of arms, with elongate member cantilevers on either side of each arm, mounted on a flat, rigid base.
Figure 5:
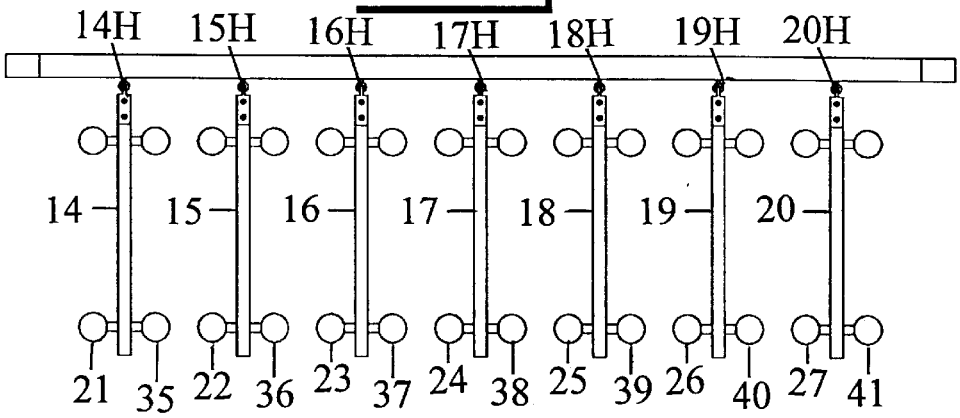
FIG. 5 is a top view of the FIG. 4 storage device.
Figure 6:
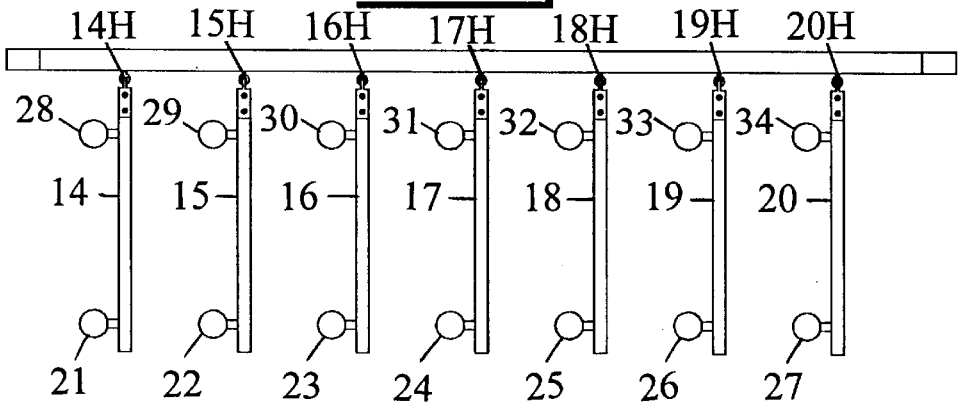
FIG. 6 is a top view similar to FIG. 5 but showing still another embodiment of a storage device for storing a plurality of suspenders and having a plurality of arms, with elongate member cantilevers on only one face of each arm, mounted on a flat, rigid base.

FIGS. 4–5 show another advantageous embodiment of the present invention comprised of a plurality of flat and substantially rigid arms 14–20 mounted by hinges 14H–20H to a rigid, inflexible base 13. Pairs of elongate member cantilevers 21–48 extend outwardly and perpendicular to the surface of both faces of each arm 14–20. Each pair elongate member cantilevers 21–48 on arms 14–20 are advantageously spaced apart approximately the width of the spacing between suspender buttons on trousers, preventing undesired disfiguring of the waistband button engaging stems of the stored suspenders. Means is provided for mounting the base 13 on a surface, usually an upright surface such as a wall or closet door. While various means are contemplated, in FIG. 4 it is shown in the form of openings 13*a* for passage of mounting fasteners (not shown). Mounting means may include depending hangers which extend over the top of a door, various picture hangers, and the likes FIG. 6 shows an embodiment of the present invention similar to the embodiment shown in FIGS. 4 and 5, except that each arm 14–20 has only one pair of elongate member cantilevers 21–34 on the face of each arm 14–20.

Figure 7:
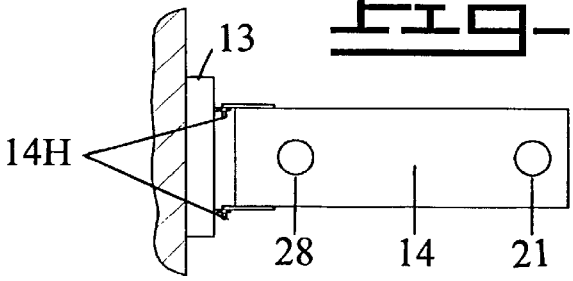
FIG. 7 is a left side view of the FIG. 4 storage device.

FIG. 7 shows a side view of one of the arms 14–20 having two elongate member cantilevers 28 and 21 on the face of the arm 14 mounted on the base 13. FIG. 7 shows how each of the flat and substantially rigid arms are advantageously connected to the base 13 via the hinged joint 14H, allowing for easier access to the stored pairs of suspenders. Other forms of hangers may be used.

Figure 8:
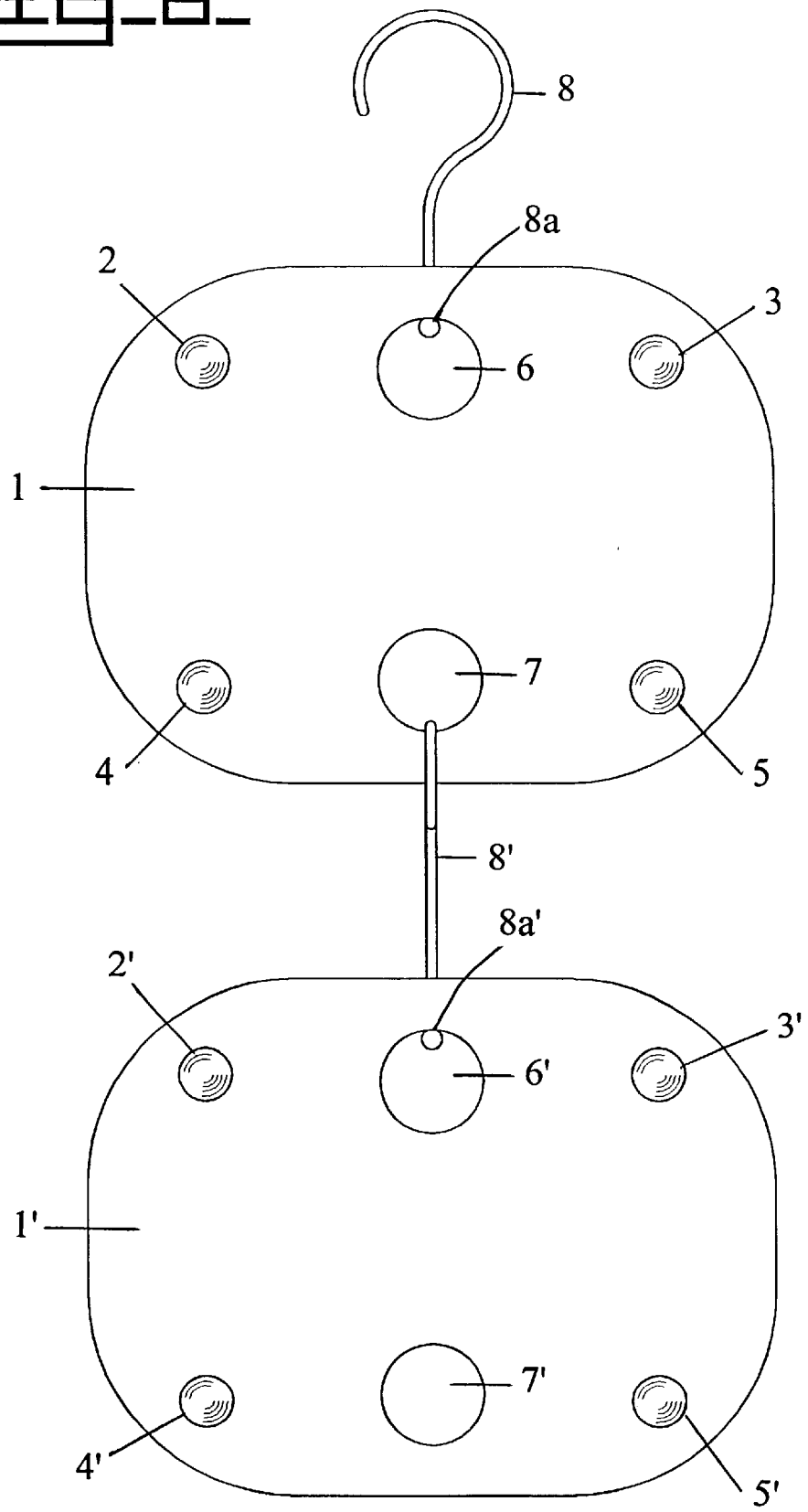
FIG. 8 is a front elevational view of two storage devices in accordance with the FIGS. 1 and 2 or 3 embodiments and with the second storage device hanging by its hook portion on the first storage device.

FIG. 8 shows two FIG. 1 and 2 or FIG. 3 storage devices for storing pairs of suspenders hooked together. The parts shown on the second storage device are indicated by the numbers corresponding to the same parts on the first storage device followed by the postscript prime (').

Here, the hook portion 8' of the second storage device is placed through the lowermost orifice 7 of the first storage device. The lowermost orifice 7 is conveniently large enough to receive the hook portion 8' of the second storage device, thereby allowing the second storage device to be connected to the first storage device. Furthermore, the lowermost orifice 7 is conveniently small enough to have sufficient retention capability, preventing the second storage device from accidentally becoming disengaged from the first storage device.

Figure 9:
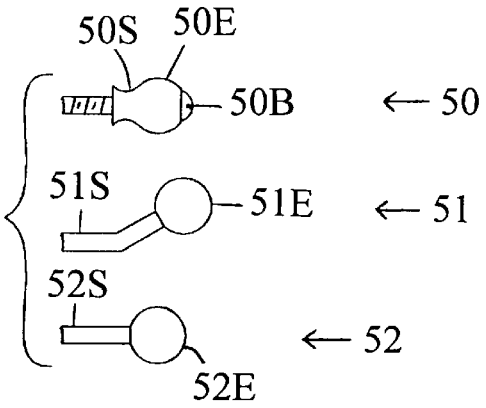
FIG. 9 is a side view of three different types of elongate member cantilevers, with varying shaped elongated member cantilevers and varying member ends.

FIG. 9 shows three different alternate examples of advantageous elongate member cantilevers 50–52. Remember that in the FIG. 2 embodiment, cantilever 4 included a washer-like shank 4S, a bolt 4B, and an internally threaded bulbous end 4E. The elongate member cantilevers 50–52 each have a shank portion 50S–52S which advantageously has a bulbous end 50E–52E for retention of the waistband button engaging stems of suspenders. In one example, the elongate member cantilever 50 advantageously has a bulbous end 50E with an integral shank 50S in the form of a reduced throat portion for easier removal of the suspenders from the storage device. A bolt 50E extends through the bulbous end 50E and shank 50S and either into or through the base 1, for example. If it extends through the base, a nut (not shown) is conveniently used as a retainer. The nut may be recessed into the base or the base may be threaded. In another example, also shown in FIG. 9, the elongate member cantilever 51 has a spherical end 51E and has a shank 51S advantageously bent at its center, extending the end 51E of the member 51 upward. This further improves the retention of the waistband button engaging stems of suspenders. The third example shown in FIG. 9 is an elongate member cantilever 52 with a spherical end 52E. Any of the embodiments illustrated in these three examples are advantageous for retaining the waistband button engaging stems of a stored pair of suspenders.

Figure 10:
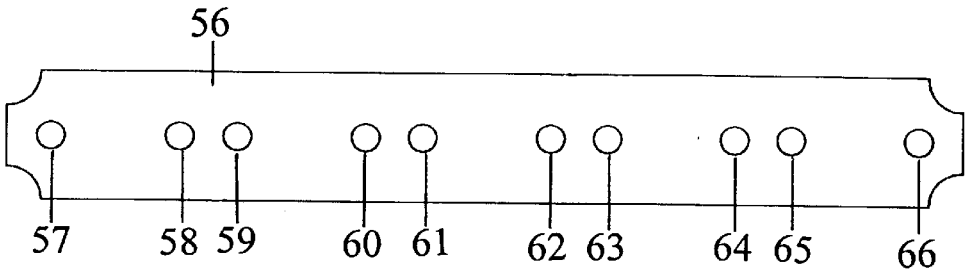
FIG. 10 is a front elevational view of a fifth embodiment of a storage device for storing suspenders comprised of an upstanding, flat and substantially rigid base and a plurality of elongate member cantilevers mounted to the base and extending outwardly and perpendicular to the surface of the base.

Another advantageous embodiment of the present invention is illustrated in FIG. 10, which shows a storage device for storing a plurality of pairs of suspenders. The elongate member cantilevers 57–66 extend outwardly and perpendicular to a flat, substantially rigid base 56, which can be mounted on a wall, on a closet door, etc., in any manner as previously described.

Figure 11:
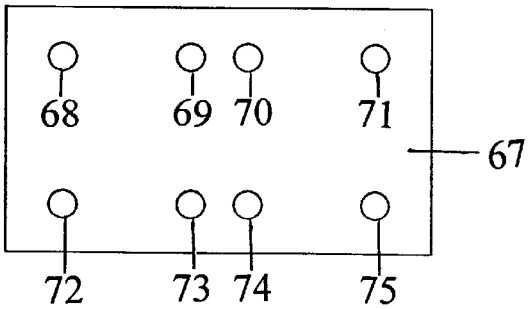
FIG. 11 is a front elevational view of a sixth embodiment of a storage device for storing suspenders comprised of an upstanding, flat and substantially rigid base, in the shape of a rectangle, and a plurality of elongate member cantilevers mounted to the base and extending outwardly and perpendicular to the surface of the base.

FIG. 11 shows an additional embodiment of the present invention that is similar to the device shown in FIG. 10 in that it is comprised of a plurality of elongate member cantilevers 68–75 extending outwardly and perpendicular to a flat, substantially rigid base 67, which can be mounted on a wall, a closet door, etc. However, the embodiment in FIG. 11 differs from that in FIG. 10 because of the rectangular shape of its base 67 and its four pairs of elongate member cantilevers 68–75 which provide the capability of the storage device to store four pairs of suspenders. This embodiment is advantageous because of its space-saving arrangement and the aesthetic value of its design. For example, the storage device may be personalized or decorated with a design or emblem added to the face of its base 67.

Figure 12:
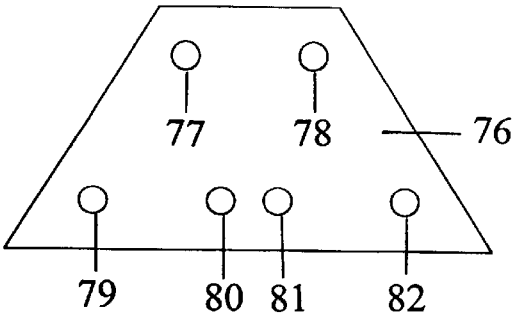
FIG. 12 is a front elevational view of a seventh embodiment of a storage device for storing suspenders comprised of an upstanding, flat and substantially rigid base, in the shape of a trapezoid, and a plurality of elongate member cantilevers mounted to the base and extending outwardly and perpendicular to the surface of the base.

FIG. 12 shows an additional embodiment of the present invention that is similar to the device shown in FIG. 10 in that it is comprised of a plurality of elongate member cantilevers 77–82 extending outwardly and perpendicular to a flat, substantially rigid base 76, which can be mounted on a wall, a closet door, etc. However, the embodiment in FIG. 12 differs from that in FIG. 10 because of the trapezoid shape of its base 76 and its three pairs of elongate member cantilevers 77–82 which provide the capability of the storage device to store three pairs of suspenders. This embodiment is also advantageous because of the aesthetic value of its design. This embodiment of the storage device may also be personalized or decorated with a design or emblem added to the face of the base 76.

It should be deemed apparent that any of the various described cantilevers (e.g., FIG. 9) may be utilized with any of the various bases (e.g., 1, 56, 76) and/or arms (e.g., 14–20) described above.

Other objects, features and advantages will be apparent to those skilled in the art. While preferred embodiments of the present invention have been illustrated and described, this has been by way of illustration and the invention should not be limited except as required by the scope of the appended claims.

We claim:

1. A suspenders storage device for storing a plurality of pairs of suspenders of the type having waistband button-engaging stems at ends thereof and comprising a flat, upstanding and substantially rigid base; a plurality of pairs of member cantilevers, wherein each pair of the plurality of pairs of member cantilevers is spaced approximately the width of spacing between suspender buttons on trousers, and the plurality of pairs of member cantilevers are mounted to the base and extending outwardly from and perpendicular to the surface of the base wherein at least one of said pairs of member cantilevers is mounted on the opposite face of the flat and substantially rigid base; the member cantilevers each having a shank portion for supporting one of the button-engaging stems of suspenders and each shank portion having a length sufficient for residence in the button-engaging stem; and each shank, having at its distal end, an attached bulbous end sized for retention of the button-engaging stem.

2. A storage device according to claim 1, wherein a third and fourth pair of member cantilevers are mounted on the opposite face of the flat and substantially rigid base.

3. A storage device according to claim 1, wherein said member cantilevers are bent at the center, thereby extending the end of the member upward.

* * * * *